US012668397B2

(12) United States Patent
Li et al.

(10) Patent No.: US 12,668,397 B2
(45) Date of Patent: Jun. 30, 2026

(54) ENVIRONMENTALLY FRIENDLY CUSHIONING PACKAGING STRUCTURE

(71) Applicant: Dongguan Xinyuan Environmental Technology Co., Ltd., Dongguan (CN)

(72) Inventors: Yuntao Li, Dongguan (CN); Zhan Luo, Dongguan (CN)

(73) Assignee: ENVIRONMENTALLY FRIENDLY CUSHIONING PACKAGING STRUCTURE, Dongguan (CN)

( * ) Notice: Subject to any disclaimer, the term of this patent is extended or adjusted under 35 U.S.C. 154(b) by 0 days.

(21) Appl. No.: 19/207,513

(22) Filed: May 14, 2025

(65) Prior Publication Data

US 2026/0042571 A1 Feb. 12, 2026

Related U.S. Application Data

(63) Continuation of application No. PCT/CN2025/091791, filed on Apr. 28, 2025.

(30) Foreign Application Priority Data

Aug. 6, 2024 (CN) ..... 202411072841.3
Aug. 6, 2024 (CN) ..... 202421890702.7

(51) Int. Cl.
*B65D 5/50* (2006.01)
*B65D 5/10* (2006.01)
*B65D 5/42* (2006.01)

(52) U.S. Cl.
CPC ..... *B65D 5/5023* (2013.01); *B65D 5/106* (2013.01); *B65D 5/4266* (2013.01)

(58) Field of Classification Search
CPC ..... B65D 5/5023; B65D 5/50; B65D 5/5002; B65D 81/03; B65D 81/113; B65D 81/05; B65D 2581/053; B65D 85/30
See application file for complete search history.

(56) References Cited

U.S. PATENT DOCUMENTS 2,808,977 A * 10/1957 Mccormick ..... B65D 5/58 206/521
5,579,989 A * 12/1996 Roy ..... B65D 5/543 229/160
10,322,845 B2 * 6/2019 Boersma ..... B65D 5/5016

FOREIGN PATENT DOCUMENTS

CN 207191880 U * 4/2018
CN 112124737 A * 12/2020 ..... B65D 5/2052

(Continued)

*Primary Examiner* — Javier A Pagan
(74) *Attorney, Agent, or Firm* — JEEN IP LAW, LLC

(57) ABSTRACT

Disclosed is a novel environmentally friendly cushioning packaging structure, including a base plate and an extendable cushioning pad, where both ends of a same side surface of the base plate are fixedly connected to two extendable ends of the cushioning pad to form an integrated structure, the cushioning pad is provided with a cushioning surface, and the base plate is provided with a fold line; the base plate is bent along the fold line toward one side of the cushioning pad and covers an outer periphery of the cushioning pad, and is bent and stretched to be in a cylindrical wrapped state, and the cushioning surface is enclosed to form a packaging cavity for accommodating a packaged article. The base plate is provided with openings at both ends in an extending direction of the fold line, and is further provided with a sealing plate for covering the openings.

9 Claims, 14 Drawing Sheets

(56) References Cited

FOREIGN PATENT DOCUMENTS

| | | | | | |
|---|---|---|---|---|---|
| CN | 219619610 | U * | 9/2023 | | |
| WO | WO-2021048563 | A1 * | 3/2021 | ..... | B65D 5/5016 |

* cited by examiner

ENVIRONMENTALLY FRIENDLY CUSHIONING PACKAGING STRUCTURE

CROSS-REFERENCE TO RELATED APPLICATIONS

This application is a continuation of co-pending International Patent Application No. PCT/CN2025/091791, filed on Apr. 28, 2025, which claims the priority and benefit of Chinese Patent Application No. 202411072841.3, filed on Aug. 6, 2024, and No. 202421890702.7, filed on Aug. 6, 2024, which is hereby incorporated by reference in its entirety.

TECHNICAL FIELD

The present disclosure belongs to the technical field of product packaging, and particularly relates to a novel environmentally friendly cushioning packaging structure.

BACKGROUND

With the rapid development of modern technology, online shopping has become an indispensable part of people's daily lives. As a result, the express delivery industry has witnessed significant growth. In order to ensure transportation safety and goods'privacy, couriers or merchants usually package the goods carefully. Cartons are the most commonly used packaging materials in express delivery due to their excellent support and protective properties. However, dimensions of cartons often do not perfectly match a shape of the goods, so the goods cannot be securely fixed inside the cartons, this can easily cause the goods to shift, collide with the cartons, or even become damaged during transportation.

In order to better solve the problems of fixing and cushioning the goods, filler materials such as shredded paper, bubble film, packing cotton, or foam are usually placed between inner walls of the cartons and a surface of the goods. However, this filling method not only involves complicated filling steps and low packaging efficiency, but also makes it difficult to control packaging costs, and is not environmentally friendly.

SUMMARY

(1) Technical Problem to be Solved

The present disclosure provides a novel environmentally friendly cushioning packaging structure, aiming to solve the problems of low packaging efficiency, high costs, and environmental pollution in the existing carton packaging and filling methods.

(2) Technical Solution

The present disclosure provides a novel environmentally friendly cushioning packaging structure, including a base plate and an extendable cushioning pad, where both ends of a same side surface of the base plate are fixedly connected to two extendable ends of the cushioning pad respectively to form an integrated structure, the cushioning pad is provided with a cushioning surface, and the base plate is provided with a fold line; and the base plate is bent along the fold line toward one side of the cushioning pad and covers an outer periphery of the cushioning pad, the cushioning pad is passively bent and stretched to be in a cylindrical wrapped state, and the cushioning surface is enclosed to form a packaging cavity for accommodating a packaged article.

Further, the base plate is provided with openings at both ends in an extending direction of the fold line, and the base plate is further provided with a sealing plate for covering the openings.

Further, the side of the cushioning pad near the opening is provided with a support portion, and the support portion is abutted between the sealing plate and the packaged article.

Further, the support portion is arranged perpendicular to the extending direction of the fold line.

Further, two end edges of the base plate and one side of the cushioning pad are provided with notches that correspond to each other, and a curved contour of each notch matches a sectional curved contour of an outer surface of the packaged article.

Further, a rotational axis P is arranged at the notch, and the cushioning pad rotates and stretches about the rotational axis P to form the wrapped state.

Further, the base plate includes a first side plate, a second side plate, a third side plate, a fourth side plate, a fifth side plate, a sixth side plate, and a seventh side plate that are rotatably connected in sequence, and one fold line is arranged at each rotational connection, and two ends of the cushioning pad are connected to the first side plate and the seventh side plate, respectively; and in the wrapped state, the first side plate and the seventh side plate are tightly fitted between two end portions of the cushioning pad.

Further, one end of the sealing plate is rotatably connected to the fourth side plate, a support plate of a right-angled triangle structure is arranged at the opening, two right-angle edges of the support plate are rotatably connected to the sealing plate and the third side plate or the fifth side plate, respectively; and the support plate is further provided with a crease configured to allow the support plate to bend and fold toward a direction of the opening.

Further, the sealing plate is rotatably connected with a latch tongue, the latch tongue is provided with a first slot, and each of the first side plate and the seventh side plate is provided with a second slot corresponding to the first slot.

Further, the cushioning pad is a honeycomb paper core formed by interlacing and bonding a plurality of paper strips, and an interior of the paper core is composed of a plurality of extendable and deformable through holes that are spliced together.

Compared with the prior art, the present disclosure has the beneficial effects:

The innovative aspect of the present disclosure lies in the integrally-linked folding design of the base plate and the extendable cushioning pad, this design enables the cushioning material to be wrapped and filled when the base plate is folded into a box-like enclosure around the packaged article, effectively improving the packaging efficiency and convenience of the packaged article. In addition, the packaging structure is made of degradable and environmentally friendly materials, which not only reduce manufacturing and usage costs but also are green and environmentally friendly.

Figure 1:
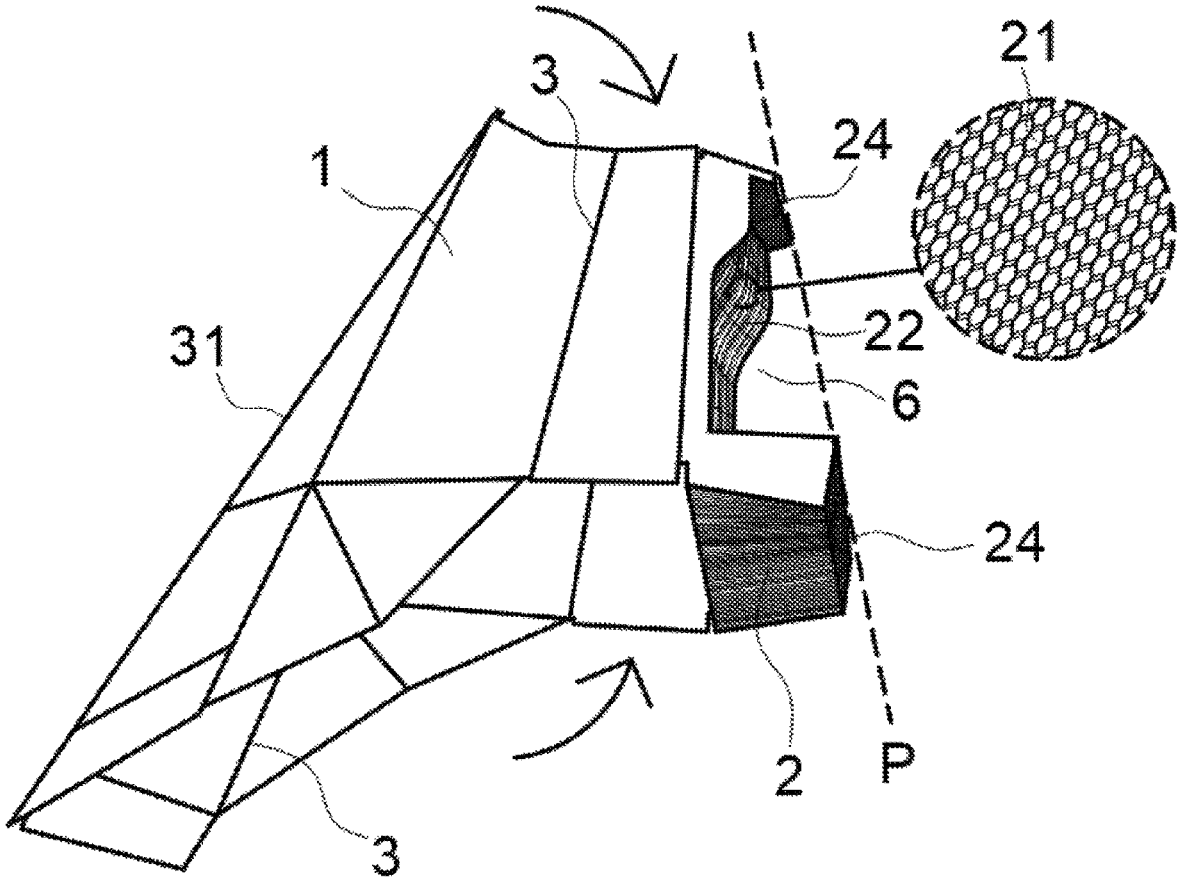
FIG. 1 is a schematic diagram of a structure according to Embodiment 1 of the present disclosure in a stowed state.

Reference numerals in the accompanying drawings: 1. base plate; 11. first side plate; 12. second side plate; 13. third side plate; 131. latch slot; 14. fourth side plate; 15. fifth side plate; 16. sixth side plate; 17. seventh side plate; 18. second slot; 19. fixing plate; 191. fixing portion; 2. cushioning pad; 21. through hole; 22. cushioning surface; 23. packaging cavity; 24. support portion; 3. fold line; 31. central fold line; 4. packaged article; 5. opening; 51. sealing plate; 511. latch tongue; 512. first slot; 513. latch tab; 52. support plate; 6. notch; 7. crease; and 8. easy-tear strip.

DETAILED DESCRIPTIONS OF THE EMBODIMENTS

In order to make the objectives, technical solutions, and advantages of the embodiments of the present disclosure clearer, the technical solutions of the embodiments of the present disclosure will be described clearly and completely with reference to the accompanying drawings of the embodiments of the present disclosure. Apparently, the described embodiments are some, but not all, embodiments of the present disclosure. Based on the embodiments of the present disclosure, all other embodiments acquired by those of ordinary skill in the art without making creative efforts fall within the scope of protection of the present disclosure.

Figure 2:
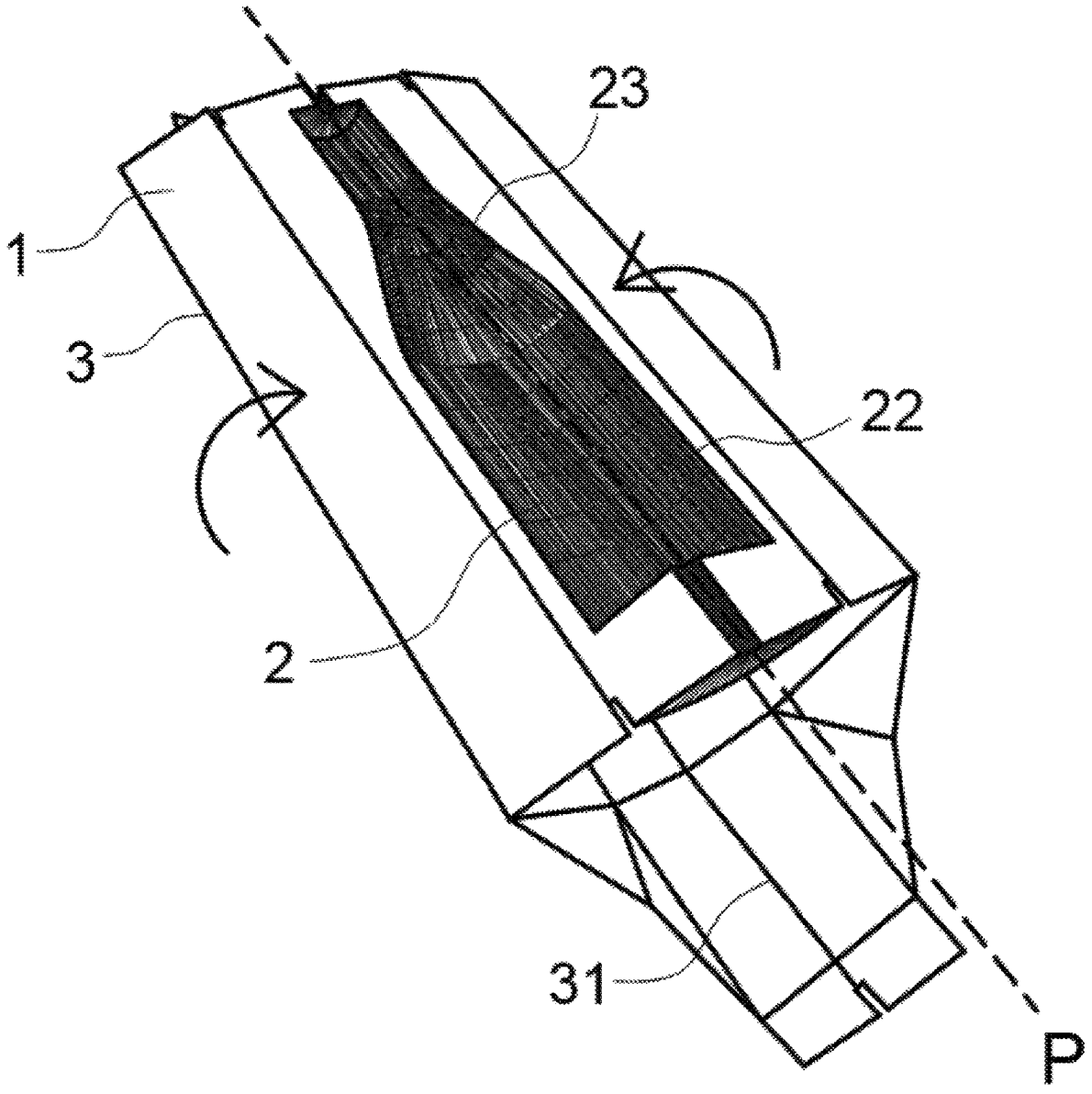
FIG. 2 is a schematic diagram of a structure according to Embodiment 1 of the present disclosure in a semi-wrapped state.
Figure 3:
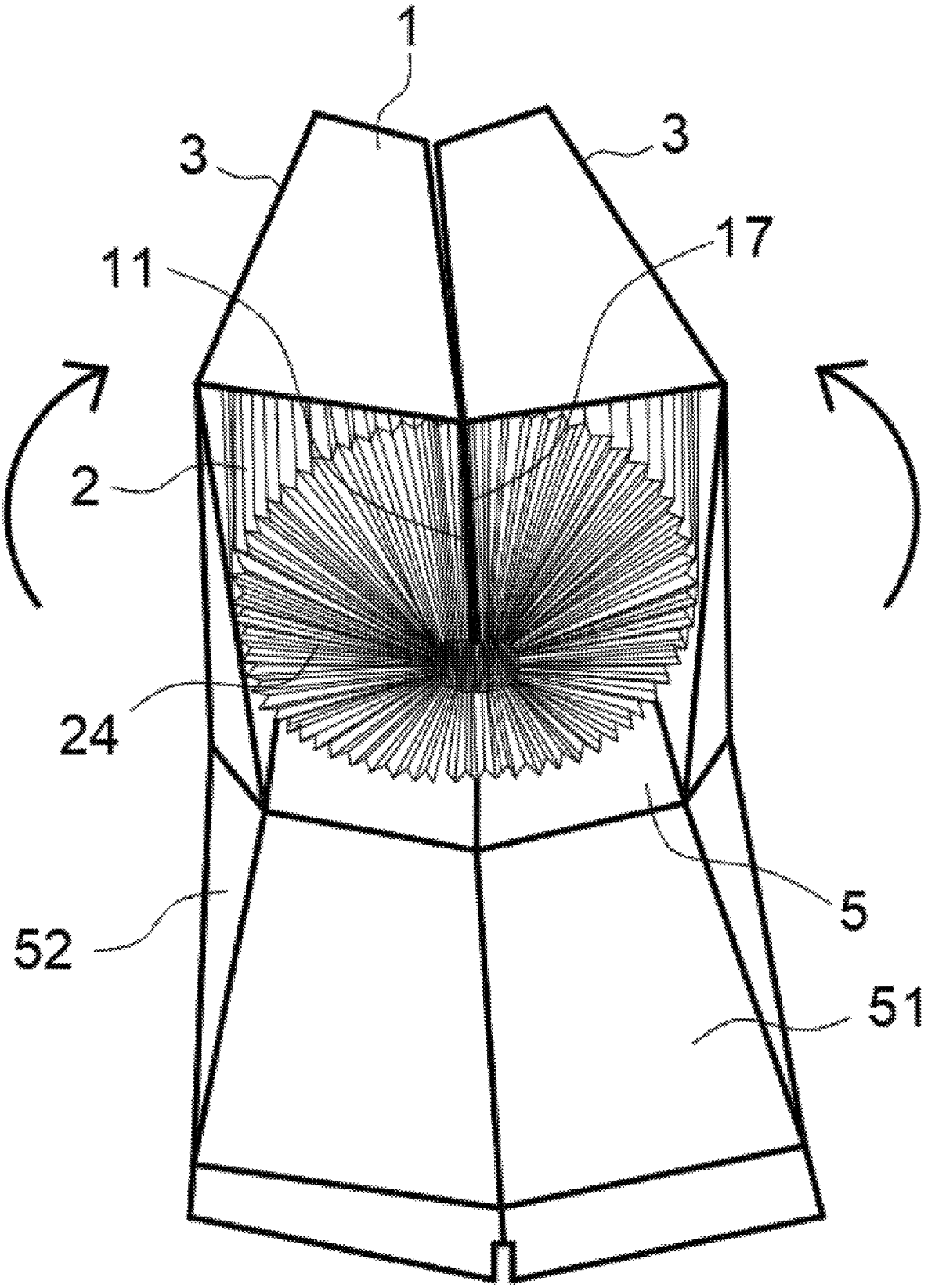
FIG. 3 is a schematic diagram of a structure according to Embodiment 1 of the present disclosure in a fully-wrapped state.
Figure 4:
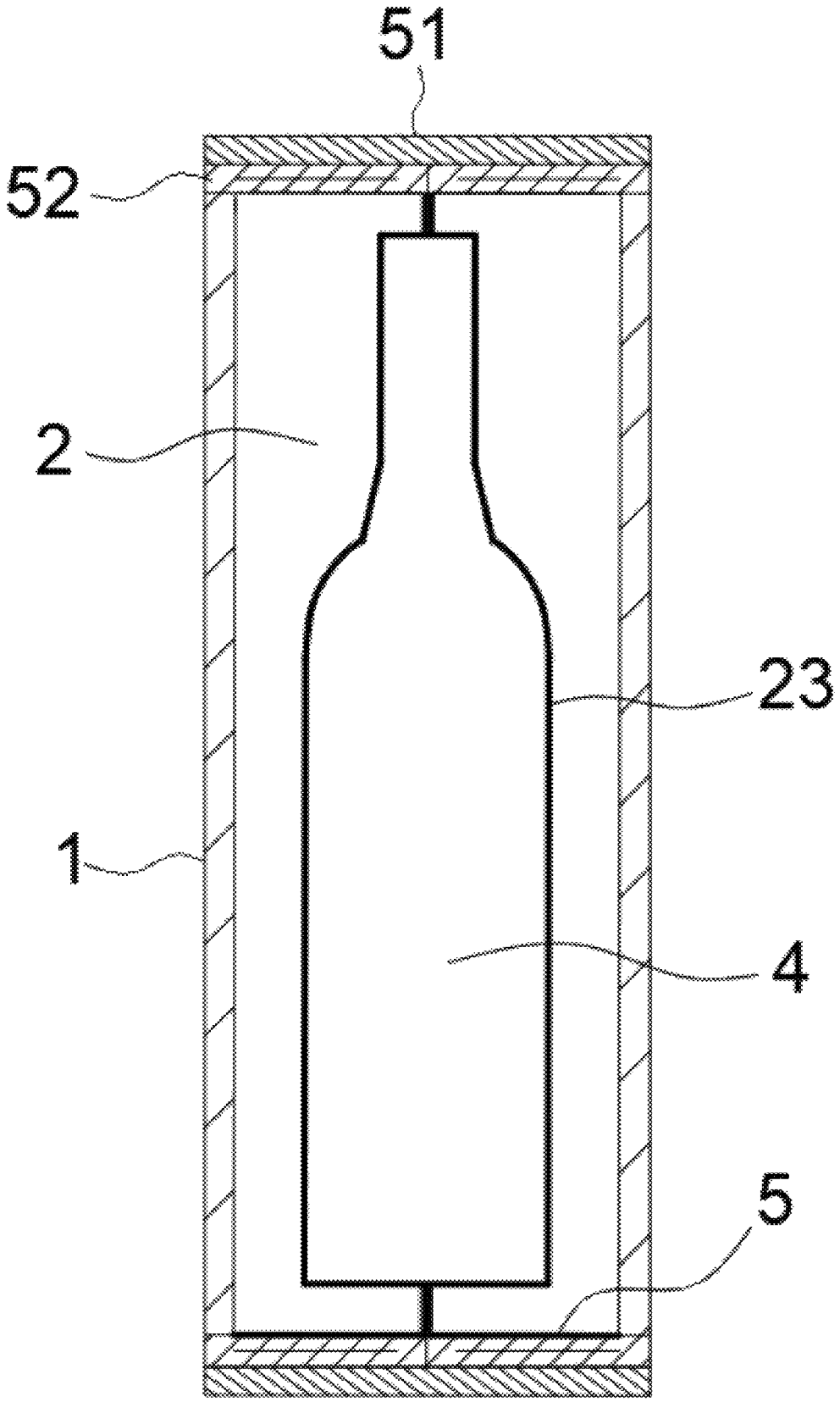
FIG. 4 is an overall sectional view according to Embodiment 1 of the present disclosure in a fully-wrapped state.

As shown in FIGS. 1-6, the present disclosure provides a novel environmentally friendly cushioning packaging structure, which includes a base plate 1 and an extendable cushioning pad 2, both ends of a same side surface of the base plate 1 are fixedly connected to two extendable ends of the cushioning pad 2 respectively to form an integrated structure, where the fixed connection may be implemented by a fixed connection structure commonly used in packaging boxes, such as adhesive bonding, snap-fit connection, and riveting connection;

the cushioning pad 2 is a honeycomb paper core formed by interlacing and bonding a plurality of paper strips, and an interior of the paper core is composed of a plurality of extendable and deformable through holes 21 that are spliced together. The through holes 21 can be deformed and expanded by pulling the two extendable ends of the cushioning pad 2, such that the expansion and contraction of the cushioning pad 2 are achieved. In addition, due to the honeycomb-shaped structure, connecting boundaries between adjacent through holes 21 provide an excellent support and cushioning effect on two end faces of the cushioning pad 2, thereby effectively increasing the cushioning and support force applied to a packaged article 4. A plurality of fold lines 3 are arranged on the base plate 1, the base plate 1 can be bent along the fold lines 3 toward one side of the cushioning pad 2 and covers an outer periphery of the cushioning pad 2, the cushioning pad 2 is passively bent and stretched under the traction of the base plate 1 to be in a cylindrical wrapped state, the end face of the cushioning pad 2 away from the base plate 1 serves as a cushioning surface 22, and in the wrapped state, the cushioning surface 22 is enclosed to form a packaging cavity 23 for accommodating the packaged article 4;

as shown in FIG. 1, a central fold line 31 is further arranged in a middle position of the base plate 1. Prior to use, the base plate 1 can be folded in half for storage under the folding action of the central fold line 31, in this case, the cushioning pad 2 is also in a folded and contracted storage state, and is fixed at the end portion of the base plate 1 away from the central fold line 31, that is, in the storage state, an overall packaging structure is flat, which is convenient for stacking and storing a plurality of packaging structures, thereby effectively saving storage space;

as shown in FIGS. 1-3, when in use, a user only needs to bend the base plate 1 along the fold lines 3 to drive the cushioning pad 2 to bend and stretch, in this case, the packaged article 4 is placed and abutted against the cushioning surface 22, the cushioning surface 22 is enclosed to form the packaging cavity 23 surrounding the packaged article 4 under the continued bending and stretching of the base plate 1 and the cushioning pad 2, and the base plate 1 forms a box structure and wraps around the outer periphery of the cushioning pad 2;

through the integrated folding and linkage design of the base plate 1 and the cushioning pad 2, the base plate 1 and the cushioning pad 2 can be quickly and easily switched between the storage state and the wrapped state, which is simple and convenient for the user to quickly wrap the packaged article 4. In addition, in the wrapped state, the base plate 1 forms a stable box structure that can provide good support and protection to the packaged article 4 inside the box, and the cushioning pad 2 disposed between inner walls of the base plate 1 and the packaged article 4 can provide enhanced cushioning protection for the packaged article 4, thereby further improving the wrapping packaging stability and safety of the packaged article 4; and since kraft paper exhibits low cost, good flexibility and tear resistance, it is most suitable as the material for the cushioning pad 2. Further, a material of the base plate 1 is preferably corrugated cardboard, such that the base plate 1 has sufficient packaging hardness and an overall material of the packaging structure is more environmentally friendly and has lower costs.

Specifically, as shown in FIG. 3, the base plate 1 is provided with openings 5 at both ends in an extending direction of the fold lines 3, the base plate 1 is further provided with a sealing plate 51 for covering the openings 5, and the side of the cushioning pad 2 near the openings 5 is provided with support portions 24 that have a same structure as that of the cushioning pad 2 and are integrally formed; and in the wrapped state, the support portions 24 are abutted between the sealing plate 51 and end portions of the packaged article 4; and it should be noted that, during a manufacturing process of the cushioning pad 2, a plurality of paper sheets are stacked in sequence, and adjacent paper sheets are bonded together, and bonding parts between the adjacent paper sheets are arranged in a staggered manner, such that the plurality of through holes 21 form a honeycomb-shaped structure when the cushioning pad 2 is stretched; after bonding is complete, it is necessary to cut the cushioning pads 2 into different thicknesses and shapes according to the actual packaging shape of the packaged article 4, and the resulting cushioning pad 2 includes a main body portion corresponding to peripheral walls of the packaged article 4 and the support portions 24 for abutting against the end surfaces of the packaged article 4. Therefore, through the ingenious structural design of the cushioning pad 2 and the support portions 24, packaging efficiency can be effectively improved, and a better fit with the packaged article 4 is achieved, thereby further improving the safety, stability, and convenience of packaging.

Figure 5:
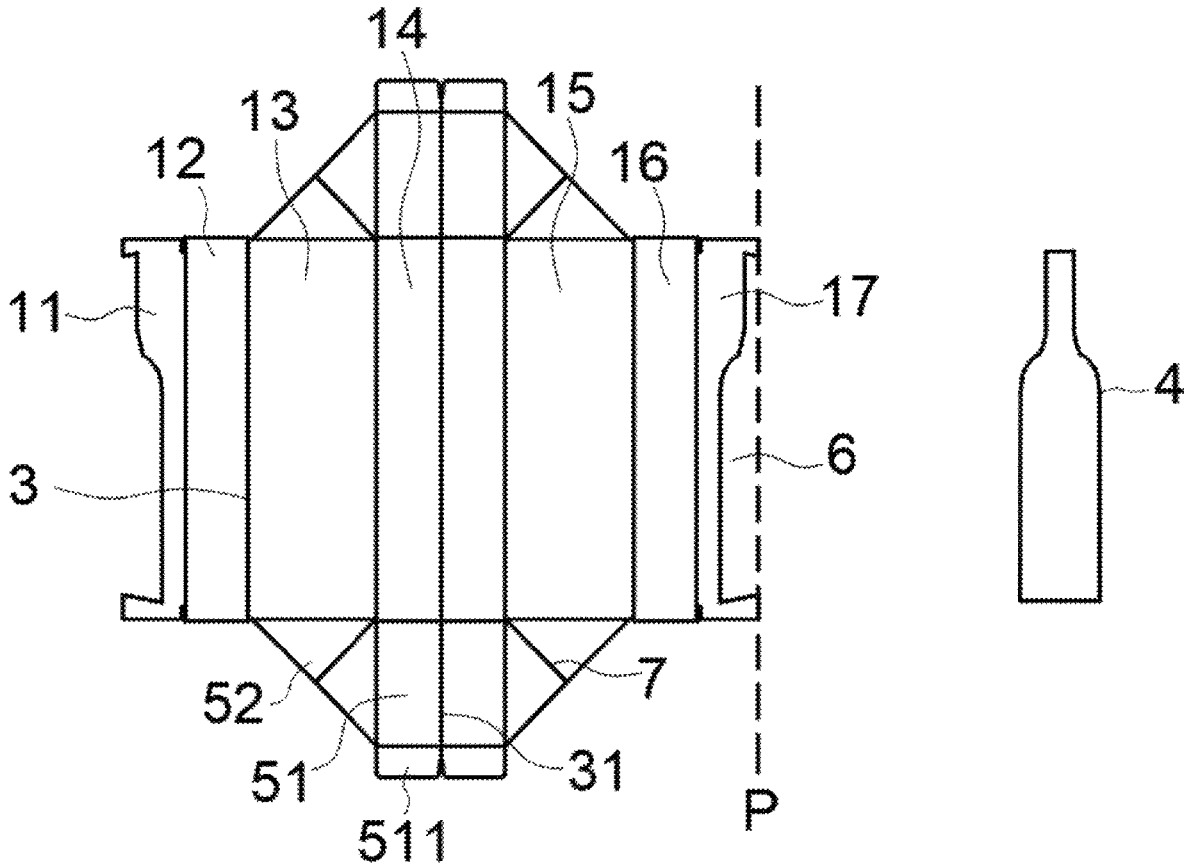
FIG. 5 is a diagram of an unfolded base plate according to Embodiment 1 of the present disclosure.
Figure 6:
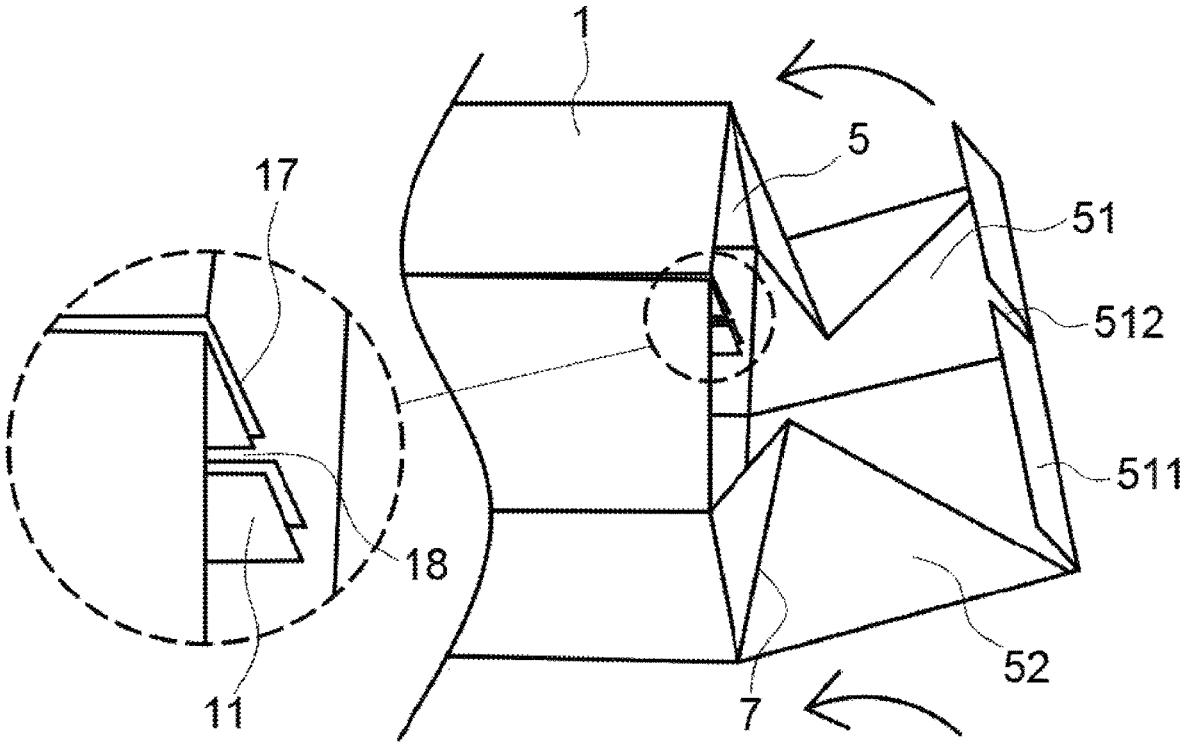
FIG. 6 is a schematic structural diagram of a sealing plate according to Embodiment 1 of the present disclosure.
Figure 7:
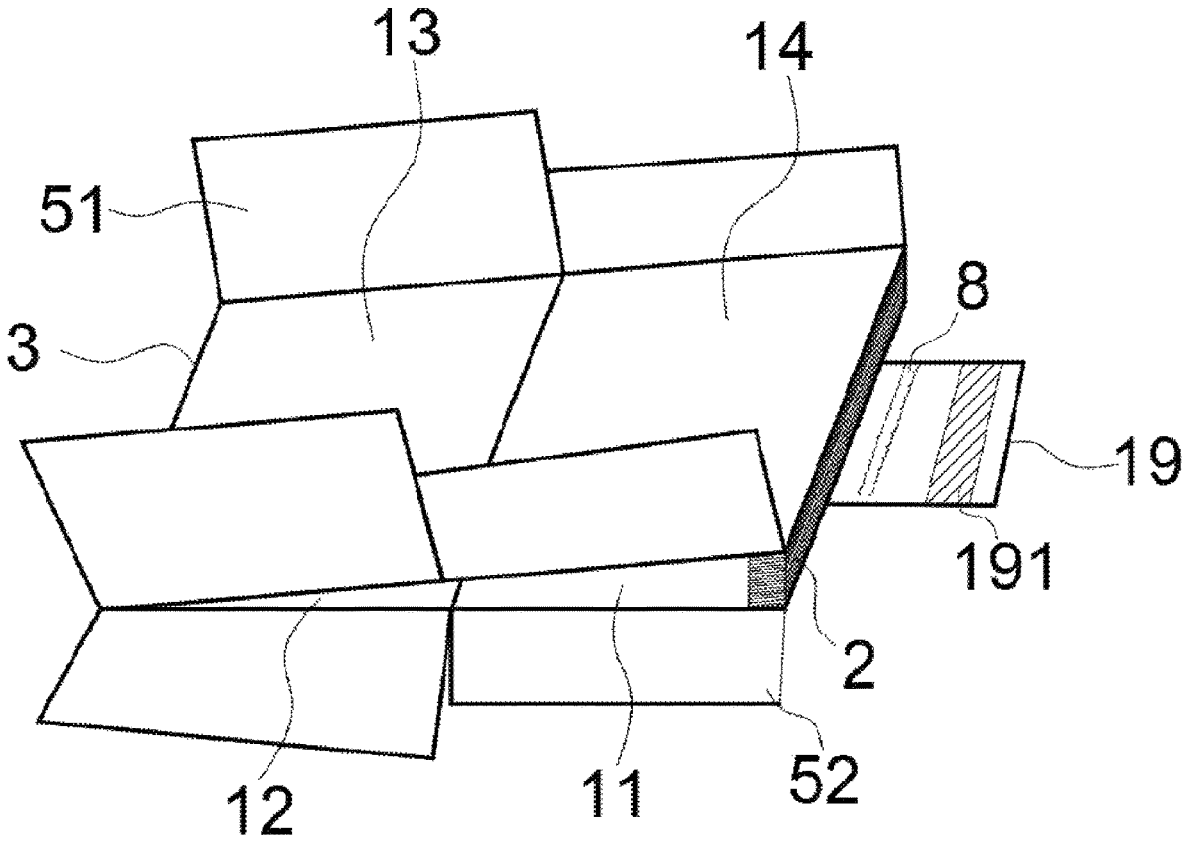
FIG. 7 is a schematic diagram of a structure according to Embodiment 2 of the present disclosure in a stowed state.
Figure 8:
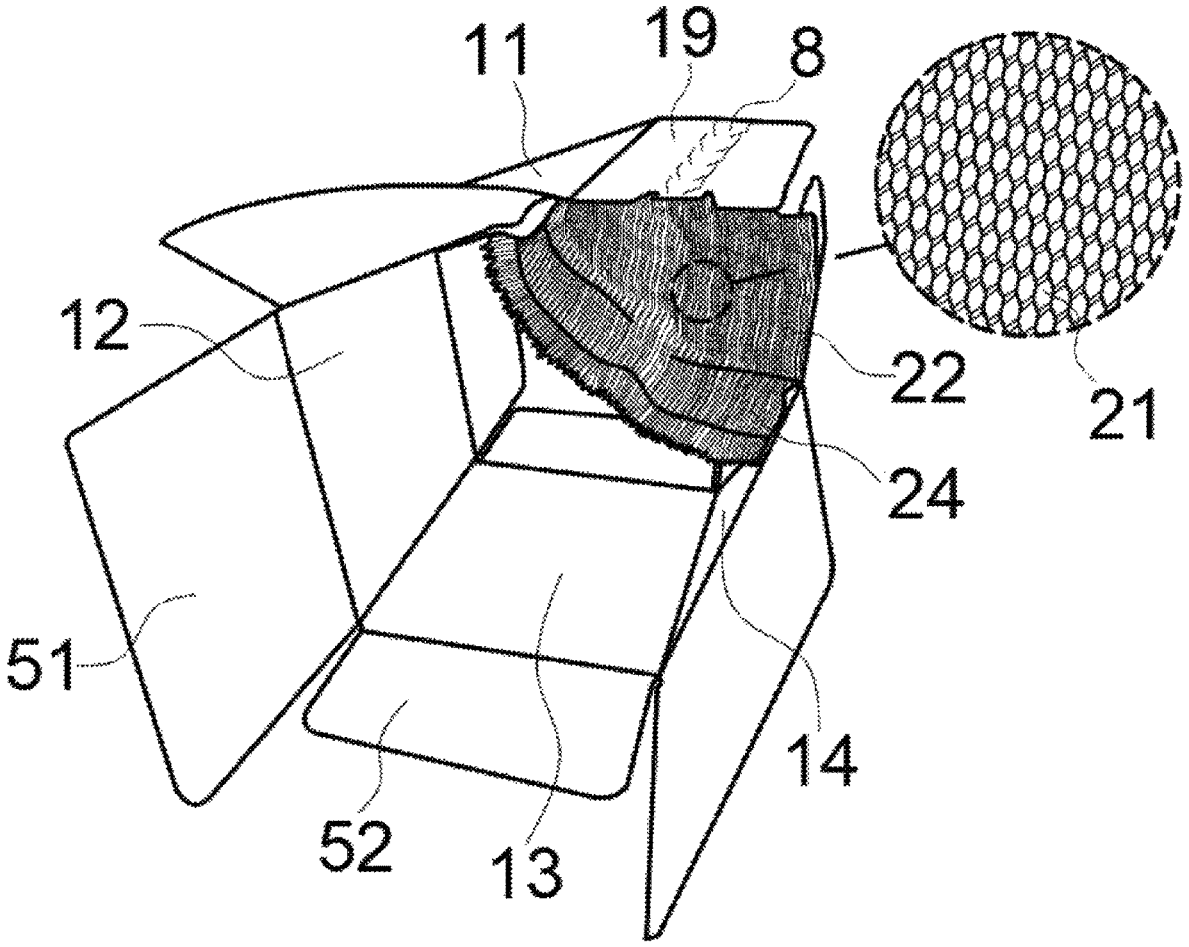
FIG. 8 is a schematic diagram of a structure according to Embodiment 2 of the present disclosure in a semi-wrapped state.
Figure 9:
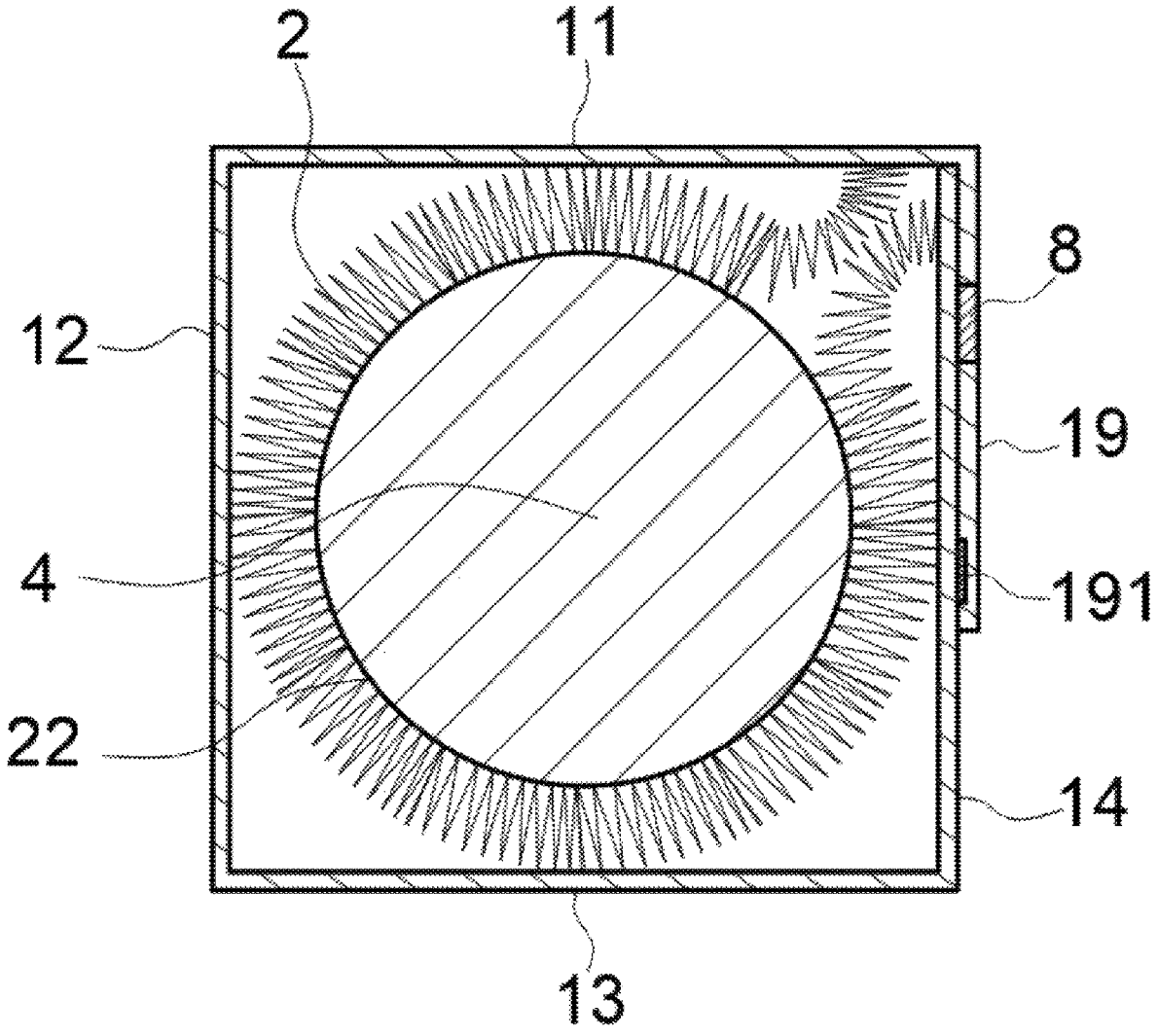
FIG. 9 is an overall sectional view according to Embodiment 2 of the present disclosure.

In Embodiment 1, as shown in FIGS. 1-6, the base plate 1 includes a first side plate 11, a second side plate 12, a third side plate 13, a fourth side plate 14, a fifth side plate 15, a sixth side plate 16, and a seventh side plate 17 that are rotatably connected in sequence, one fold line 3 is arranged in each rotational connection position, and two ends of the cushioning pad 2 are fixedly connected to the first side plate 11 and the seventh side plate 17, respectively. In the wrapped state, the two ends of the cushioning pad 2 remain fixedly connected to the first side plate 11 and the seventh side plate 17, while the other end faces of the first side plate 11 and the seventh side plate 17 are tightly abutted against each other;

specifically, as shown in FIGS. 1 and 5, in this embodiment, the support portions 24 are arranged perpendicular to the extending direction of the fold line 3 or in a length direction of the cushioning pad 2, such that the cushioning pad 2 forms a "C"-shaped structure as a whole, a notch 6 is formed in the "C"-shaped structure, and a curved contour of the notch 6 matches a sectional curved contour of an outer surface of the packaged article 4, that is, end edges of the first side plate 11 and the seventh side plate 17, as well as one side edge of the cushioning pad 2, are provided with corresponding notches 6, and shapes of the first side plate 11 and the seventh side plate 17 are adapted to an extendable end face shape of the cushioning pad 2;

through the arrangement of the notch 6, when the base plate 1 and the cushioning pad 2 in the wrapped state, an inner peripheral wall structure of the packaging cavity 23 can closely conform to an outer peripheral wall structure of the packaged article 4, such that contact area and adaptability between the cushioning pad 2 and the outer peripheral wall of the packaged article 4 are further increased, the packaged article 4 is effectively provided with more comprehensive cushioning and support, as well as cushioning force and securing effect. In this embodiment, the packaged article 4 is preferably a bottle-like fragile product, such as an alcoholic beverage or a glass crystal product;

further, a rotational axis P is arranged at the notch 6; and when the base plate 1 drives the cushioning pad 2 to bend and stretch, the cushioning pad 2 rotates and stretches about the rotational axis P to form the wrapped state;

more further, as shown in FIGS. 5-6, one end of the sealing plate 51 is rotatably connected to the fourth side plate 14, two support plates 52 of right-angled triangle structures are arranged at the opening 5, the two support plates 52 are symmetrically arranged at the opening 5, two right-angle edges of one support plate 52 are rotatably connected to the sealing plate 51 and the third side plate 13, respectively, and two right-angle edges of the other support plate 52 are rotatably connected to the sealing plate 51 and the fifth side plate 15, respectively; and each support plate 52 is further provided with a crease 7 configured to allow the support plate 52 to bend and fold toward a direction of the opening 5;

it should be noted that a plurality of the sealing plates 51 and/or the support plates 52 of non-right-angled triangle structures may also be arranged at the opening 5, and the opening 5 may be fixedly covered by stacking the sealing plates 51 and/or the support plates 52 with each other. However, in this embodiment, the support plates 52 of the right-angled triangle structure are preferably used. Compared with the stacking method of the plurality of the sealing plates 51 and/or the support plates 52, two sides of each of the support plates 52 of the right-angled triangle structure is integrally connected to the base plate 1 and the sealing plate 51, and adopts a folding design via the crease 7, such that when the opening 5 needs to be sealed, the user only needs to push the sealing plate 51 toward the opening 5. Driven by the sealing plates 51, the two support plates 52 automatically bend and fold along the crease 7 and are stored between the cushioning pad 2 and the sealing plate 51, making the packaging more convenient and faster. In addition, by folding the support plates 52 inward to form a double-layer structure, the base plate 1 can provide greater support force to the support portion 24, thereby improving the packaging safety of the packaged article 4; and preferably, the end of the sealing plate 51 away from the fourth side plate 14 may be connected to the opening 5 by a connection method commonly used for the packaging boxes, such as adhesive bonding, snap-fit connection, and riveting connection. In this embodiment, the sealing plate 51 and end portions of the opening 5 preferably adopt the snap-fit connection, that is, a latch tongue 511 is rotatably connected to the sealing plate 51, the latch tongue 511 may also be configured as a double-layer structure, a first slot 512 is formed on the latch tongue 511, and the first side plate 11 and the seventh side plate 17 are each provided with a second slot 18 corresponding to the first slot 512. When in use, the sealing plate 51 is pushed to cover the opening 5, the latch tongue 511 is inserted into an inner side of an enclosure formed by the base plate 1, and the first slot 512 is snap-fitted and fixed with the second slot 18, such that the sealing plate 51 can quickly and conveniently seal the opening 5 without glue, which is ingeniously designed and environmentally friendly.

In Embodiment 2, as shown in FIGS. 7-11, the base plate 1 includes a first side plate 11, a second side plate 12, a third side plate 13, and a fourth side plate 14 that are rotatably connected in sequence, one fold line 3 is arranged in each rotational connection position, two ends of the cushioning pad 2 are fixedly connected to the first side plate 11 and the fourth side plate 14, respectively, a fixing plate 19 is arranged on either the first side plate 11 or the fourth side plate 14, and a fixing portion 191 is arranged on the fixing plate 19;

in the wrapped state, free end edges of the first side plate 11 and the fourth side plate 14 abut against each other, the cushioning pad 2 is located on an inner side of the base plate 1 to form a wrapped state, and the fixing portion 191 of the fixing plate 19 is fixedly connected to outer peripheral walls of the fourth side plate 14 or the first side plate 11, such that the base plate 1 maintains a box-like structure. The fixing connection may be adhesive bonding, snap-fit connection, riveting connection, and the like. In this embodiment, the fixing portion 191 is provided with adhesive, and is bonded to the outer peripheral walls of the fourth side plate 14 or the first side plate 11;

specifically, the fixing plate 19 is provided with an easy-tear strip 8 in an extending direction of the fold line 3, and the easy-tear strip 8 is located in a position of rotational connection between the fixing plate 19 and the base plate 1 and the fixing portion 191; and taking the rotational connection between the fixing plate 19 and the first side plate 11 as an example, when in use, the user bonds the fixing portion 191 on the fixing plate 19 onto the fourth side plate 14, such that the base plate 1 and the cushioning pad 2 form a wrapped state, which is convenient for transportation and protection of the packaged article 4. After delivery is completed and it is necessary to take out the packaged article 4, the wrapped state can be released by tearing the easy-tear strip 8 to separate the fixing portion 191 and the fixing plate 19 from the rotational connection of the base plate 1, and the packaged article 4 can be then taken out. Therefore, the design of the fixing plate 19 and the easy-tear strip 8 further improves the convenience of packaging of the packaged article 4 and taking it out after packaging.

Figure 10:
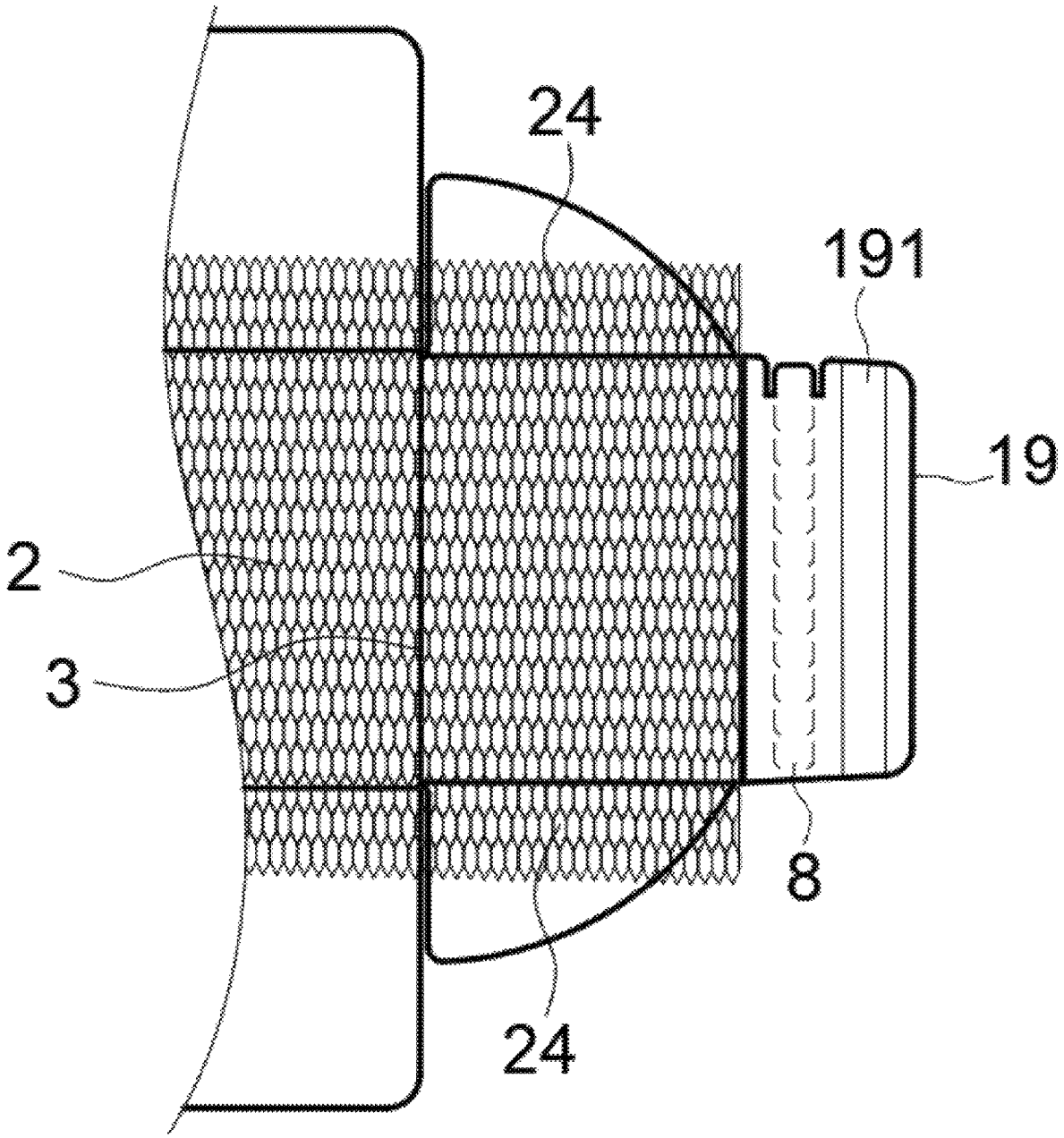
FIG. 10 is a diagram of an unfolded base plate according to Embodiment 2 of the present disclosure.
Figure 11:
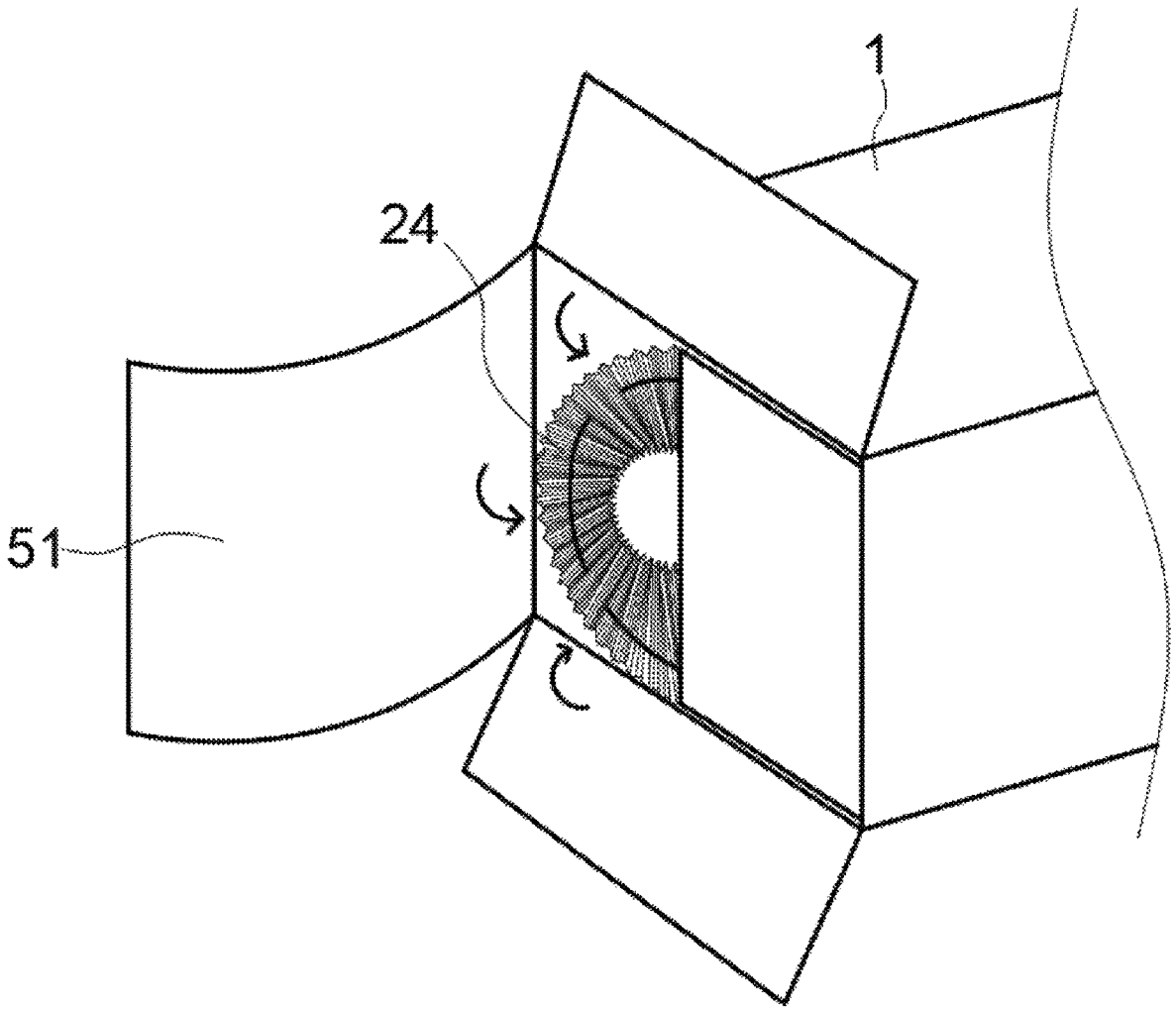
FIG. 11 is a schematic diagram of a sealing plate abutting against a support portion according to Embodiment 2 of the present disclosure.
Figure 12:
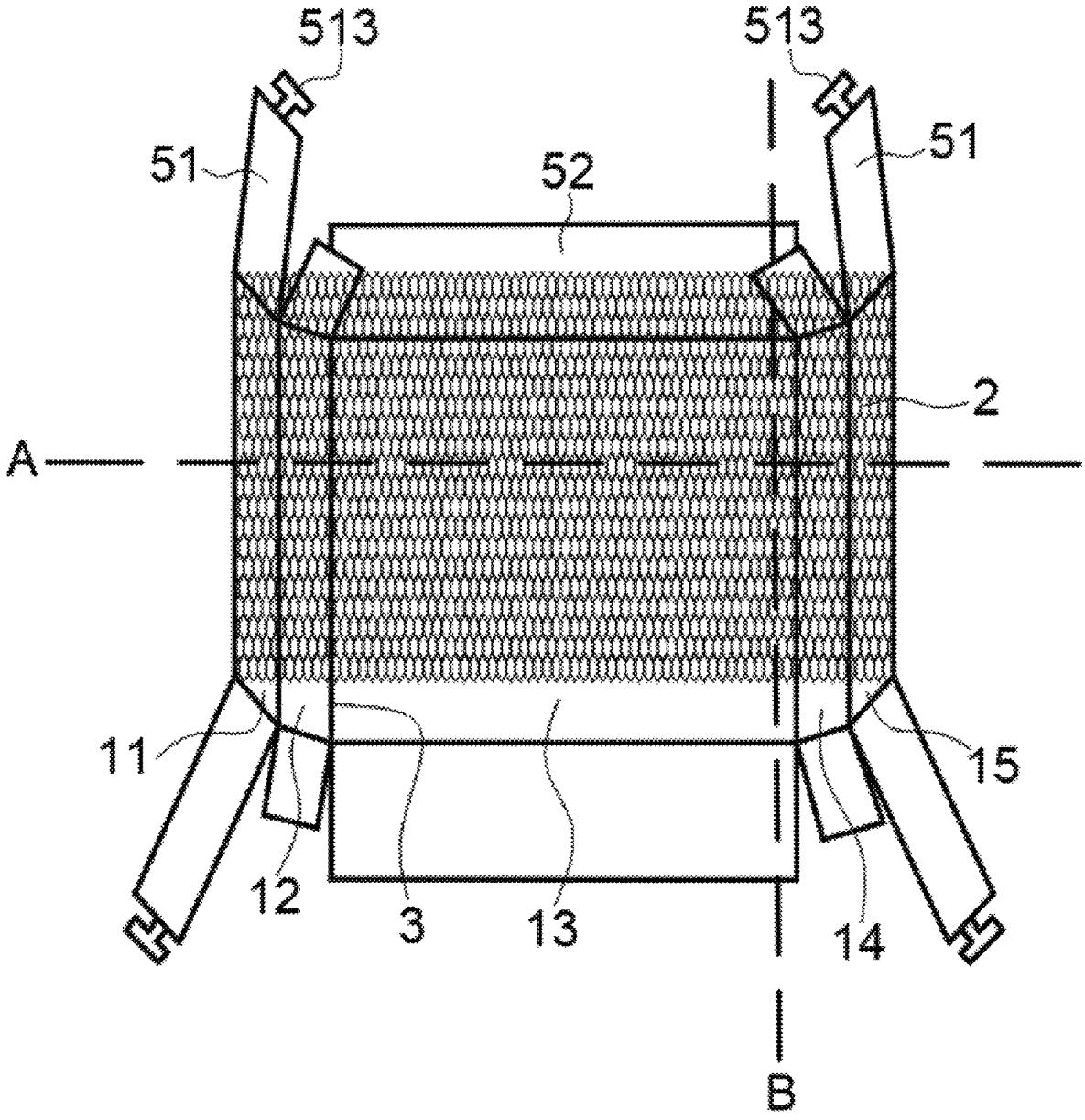
FIG. 12 is a diagram of an unfolded base plate according to Embodiment 3 of the present disclosure.

Further, as shown in FIGS. 10-11, in this embodiment, the support portion 24 may also be arranged in the extending direction of the fold line 3, that is, the cushioning pad 2 is an elongated structure as a whole. Therefore, in the wrapped state, the cushioning pad 2 forms a cylindrical structure, and wraps around the packaged article 4 to provide cushioning and fixation. Since an extending direction of the support portion 24 is consistent with the extending direction of the fold line 3, the support portion 24 extends outward through the opening 5, but under the limiting action of the sealing plate 51, the support portion 24 is bent by the limiting plate 51 and toward an end portion of the packaged article 4, and finally abuts between the packaged article 4 and the sealing plate 51 to provide effective support and fixation for the end portion of the packaged article 4; and a sealing structure of the opening 5 in this embodiment is the same as that described above and will not be repeated here.

Figure 13:
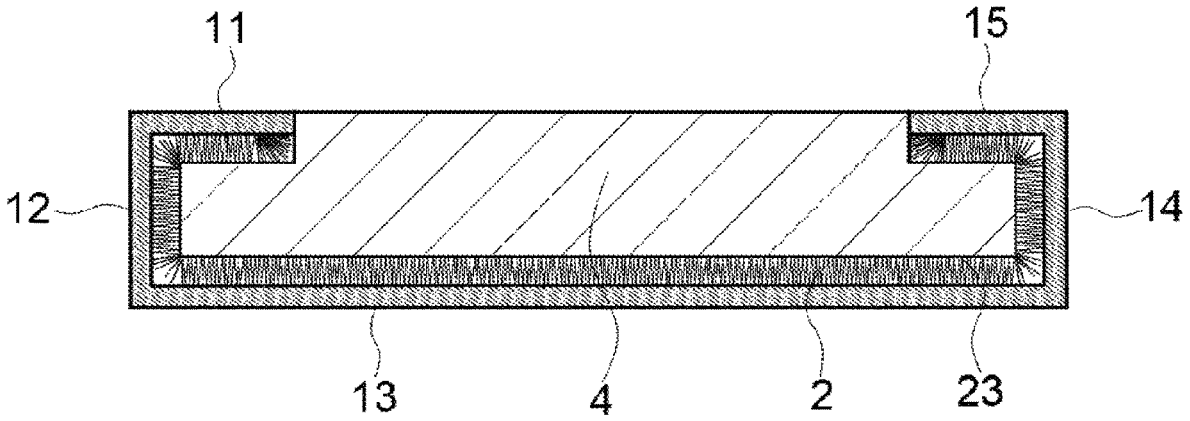
FIG. 13 is a sectional view along the sectional line A in FIG. 12 according to the present disclosure.
Figure 14:
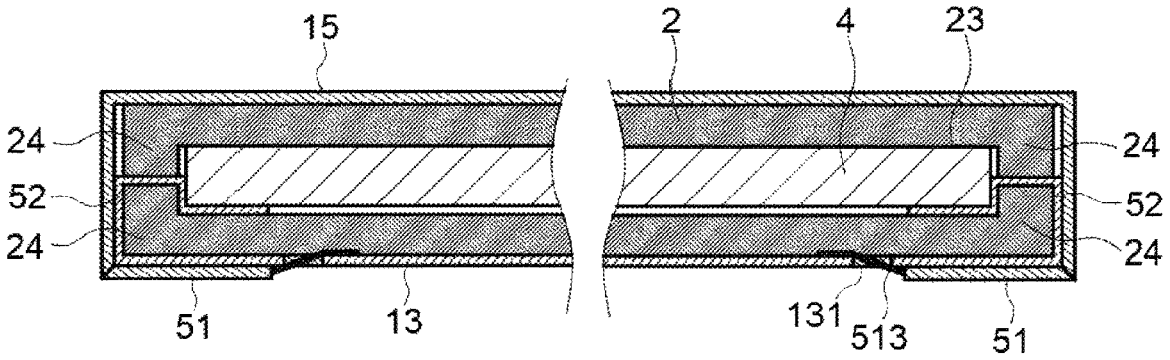
FIG. 14 is a sectional view along the sectional line B in FIG. 12 according to the present disclosure.
Figure 15:
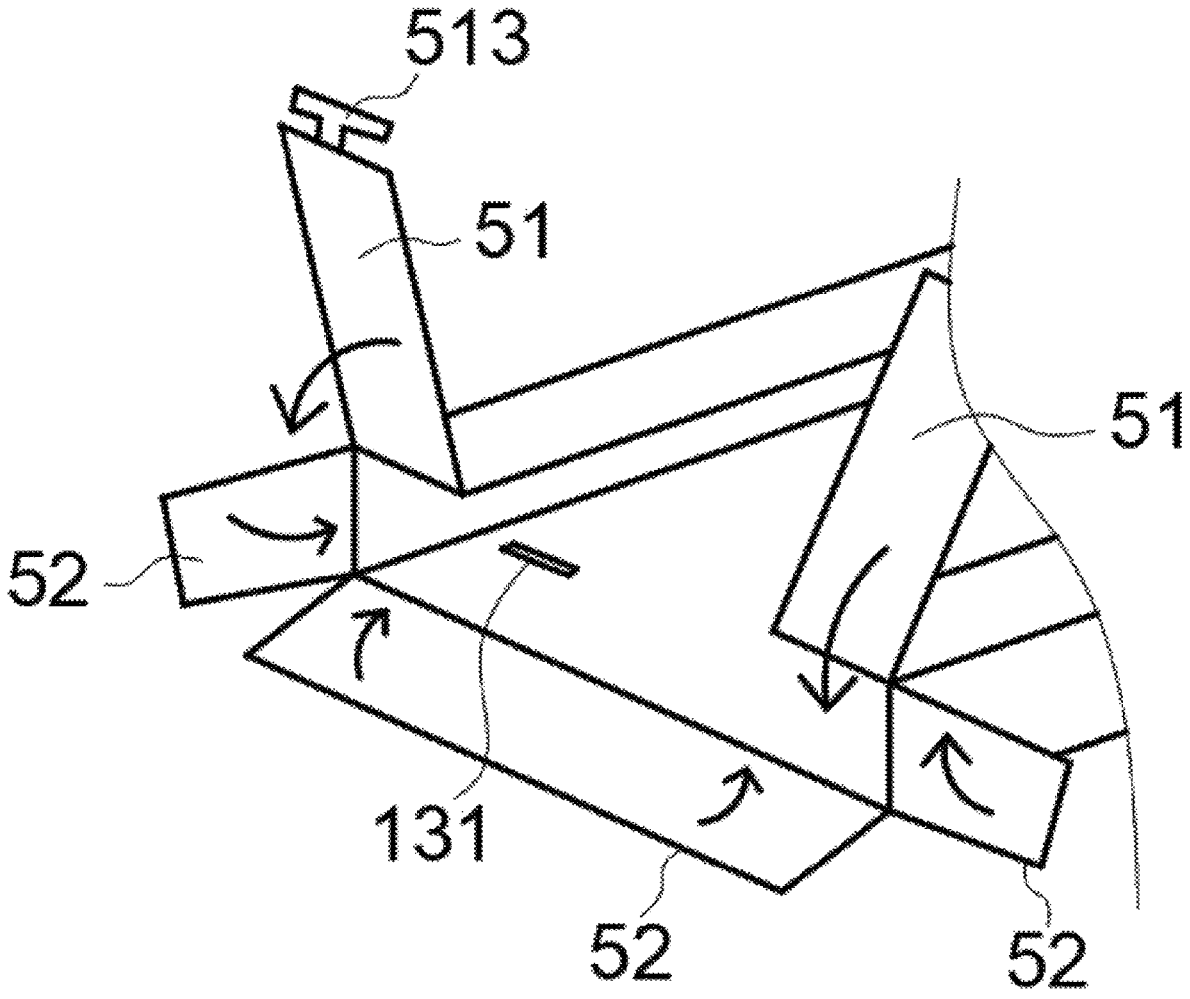
FIG. 15 is a schematic structural diagram of a sealing plate according to Embodiment 3 of the present disclosure.

In Embodiment 3, as shown in FIGS. 12-15, since some packaged articles 4 (such as display screens) are excessively large in volume, and the packaged articles 4 have partially rigid surfaces (such as rear housing) that do not require cushioning, a semi-enclosed packaging structure may be used for packaging the packaged articles 4, that is, in this embodiment, the base plate 1 includes a first side plate 11, a second side plate 12, a third side plate 13, a fourth side plate 14, and a fifth side plate 15 that are rotatably connected in sequence, one fold line 3 is arranged in each rotational connection position, and two ends of the cushioning pad 2 are fixedly connected to the first side plate 11 and the fifth side plate 15, respectively;

specifically, as shown in FIG. 13, in the wrapped state, the first side plate 11 and the fifth side plate 15 are of a same shape, and are symmetrically fixed on both sides of a back of the packaged article 4; the second side plate 12 and the fourth side plate 14 are also of a same shape, and are symmetrically disposed on two sidewalls of the packaged article 4; the third side plate 13 has a largest area and corresponds to a front portion of the packaged article 4 that requires the greatest protection (such as a screen area of the display screen), in this case, the packaged article 4 is placed inside the packaging cavity 23, and the back sides, the side walls and the front portion of the packaged article 4 are all tightly wrapped by the stretched cushioning pad 2. Through the wrapping configuration of the cushioning pad 2 and the base plate 1, double cushioning and fixation protection of the important part of the packaged article 4 are effectively achieved;

further, as shown in FIG. 14, the cushioning pad 2 is also provided with a support portion 24 extending perpendicular to the fold line 3; when in use, the support portion 24 surrounds and wraps around an edge of the packaged article 4 near the opening 5, thereby achieving positional retention and fixation of the packaged article 4. Since the edge of the packaged article 4 (such as the display screen) has a right-angle structure, the support portion 24, which also has a right-angle structure, can better fit the edge of the packaged article 4, thereby improving the stability of fixation of the packaged article 4;

more further, as shown in FIGS. 14-15, at the opening 5, each of the first side plate 11 and the fifth side plate 15 is rotatably connected to one sealing plate 51, the other end of the sealing plate 51 away from the first side plate 11 or the fifth side plate 15 is provided with a latch tab 513, and the third side plate 13 is provided with a latch slot 131 corresponding to the latch tab 513; in addition, the second side plate 12, the third side plate 13, and the fourth side plate 14 are each provided with the support plate 52;

during packaging, the base plate 1 and the cushioning pad 2 are wrapped around the packaged article 4 to form a wrapped state, the packaged article 4 is placed inside the packaging cavity 23, the support plate 52 on the third side plate 13 is first folded to wrap the support portion 24 of the cushioning pad 2, the other plurality of support plates 52 are then stacked in sequence to cover the opening 5 and abut against the end portion of the support portion 24, one part of the sealing plate 51 is bent to cover an outermost layer of the support plates 52 and then further bent, such that the other part of the sealing plate abuts against a back of the third side plate 13, and finally, the latch tab 513 is snapped into the snapped into the latch slot 131 on the third side plate 13 to fix the box-like structure of the base plate 1; and it should be noted that the sealing plate 51 may also be fixedly connected to either outermost layer of the support plates 52 or the back of the third side plate 13 by binding or riveting connection.

Working principle of the present disclosure will be described in detail below:

when in use, the base plate 1 and the cushioning pad 2 in an unfolded state are first unfolded, the packaged article 4 is then pressed against the cushioning surface 22 of the cushioning pad 2, the base plate 1 is rotated and bent along the fold lines 3 and the packaging cavity 23 or the packaged article 4 under the pressing force, and the cushioning pad 2 is driven to passively stretch and wrap around the packaging cavity 23 to form a wrapped state, thereby securely enclosing the packaged article 4; the support plate 52 and the sealing plate 51 are then used to seal the opening 5 by means of adhesive bonding, snap-fit connection, and riveting connection, thereby realizing rapid packaging of the packaged article 4.

The innovative aspect of the present disclosure lies in the integrally-linked folding design of the base plate and the extendable cushioning pad, which enables the wrapping and filling of the cushioning material during the box-like enclosure of the packaged article by the base plate, effectively improving the packaging efficiency and convenience of the packaged article. In addition, the materials used in the packaging structure are made of degradable and environmentally friendly materials, which not only reduce manufacturing and usage costs but also are green and environmentally friendly.

In addition, it should be understood that although the description is described according to implementations, each implementation does not include only one independent technical solution, the description is for clarity only, and those skilled in the art should take the description as a whole, the technical solutions in the various embodiments may be appropriately combined to form other implementations understandable by those skilled in the art.

For those skilled in the art, it is apparent that the present disclosure is not limited to details of the exemplary embodiments, and the present disclosure can be implemented in other specific forms without departing from the spirit or basic features of the present disclosure. Therefore, the embodiments should be regarded as illustrative and non-restrictive no matter from which point of view. The scope of the present disclosure is defined by the appended claims rather than the above specification, and therefore, it is intended that all changes which fall within the meaning and scope of equivalency of the claims are embraced in the present disclosure. Any reference numeral in the claims should not be construed as limiting the related claims.

What is claimed is:

1. A novel environmentally friendly cushioning packaging structure, comprising: a base plate and an extendable cushioning pad, wherein both ends of a same side surface of the base plate are fixedly connected to two extendable ends of the cushioning pad and form an integrated structure, the cushioning pad is provided with a cushioning surface, and the base plate is provided with a fold line; and the base plate is bent along the fold line toward one side of the cushioning pad and covers an outer periphery of the cushioning pad, the cushioning pad is bent and stretched to be in a cylindrical wrapped state, and the cushioning surface is enclosed to form a packaging cavity for accommodating a packaged article;

wherein the base plate comprises a first side plate, a second side plate, a third side plate, a fourth side plate, a fifth side plate, a sixth side plate, and a seventh side plate that are rotatably connected in sequence, and one fold line is arranged at each rotational connection, and two ends of the cushioning pad are connected to the first side plate and the seventh side plate respectively; and in the wrapped state, the first side plate and the seventh side plate are tightly fitted between two end portions of the cushioning pad.

2. The novel environmentally friendly cushioning packaging structure according to claim 1, wherein the base plate is provided with openings at both ends in an extending direction of the fold line, and the base plate is provided with a sealing plate for covering the openings.

3. The novel environmentally friendly cushioning packaging structure according to claim 2, wherein the side of the cushioning pad near the opening is provided with a support portion, and the support portion is configured to abut between the sealing plate and the packaged article.

4. The novel environmentally friendly cushioning packaging structure according to claim 3, wherein the support portion is arranged perpendicular to the extending direction of the fold line.

5. The novel environmentally friendly cushioning packaging structure according to claim 1, wherein two end edges of the base plate and one side of the cushioning pad are provided with notches that correspond to each other, and a curved contour of each notch is configured to match a sectional curved contour of an outer surface of the packaged article.

6. The novel environmentally friendly cushioning packaging structure according to claim 5, wherein a rotational axis (P) is arranged at the notch, and the cushioning pad rotates and stretches about the rotational axis (P) to form the wrapped state.

7. The novel environmentally friendly cushioning packaging structure according to claim 1, wherein one end of the sealing plate is rotatably connected to the fourth side plate, a support plate of a right-angled triangle structure is arranged at the opening, and two right-angle edges of the support plate are rotatably connected to the sealing plate and the third side plate or the fifth side plate, respectively; and the support plate is further provided with a crease configured to allow the support plate to bend and fold toward a direction of the opening.

8. The novel environmentally friendly cushioning packaging structure according to claim 7, wherein the sealing plate is rotatably connected with a latch tongue, the latch tongue is provided with a first slot, and each of the first side plate and the seventh side plate is provided with a second slot corresponding to the first slot.

9. The novel environmentally friendly cushioning packaging structure according to claim 1, wherein the cushioning pad is a honeycomb paper core formed by interlacing and bonding a plurality of paper strips, and an interior of the paper core is formed by plurality of extendable and deformable through holes that are spliced together.

* * * * *